US010308416B2

(12) United States Patent
Ngoc Thu

(10) Patent No.: US 10,308,416 B2
(45) Date of Patent: Jun. 4, 2019

(54) APPARATUS FOR THERMAL CONDITIONING A PRODUCT

(75) Inventor: Huynh Thi Ngoc Thu, Ho Chi Minh (VN)

(73) Assignee: TECHITHOT LIMITED, Hong Kong (HK)

( * ) Notice: Subject to any disclaimer, the term of this patent is extended or adjusted under 35 U.S.C. 154(b) by 335 days.

(21) Appl. No.: 12/236,815

(22) Filed: Sep. 24, 2008

(65) Prior Publication Data

US 2010/0047125 A1 Feb. 25, 2010

Related U.S. Application Data

(60) Provisional application No. 61/091,704, filed on Aug. 25, 2008.

(51) Int. Cl.
*A61L 2/04* (2006.01)
*B65D 81/34* (2006.01)

(52) U.S. Cl.
CPC ..... *B65D 81/3484* (2013.01)

(58) Field of Classification Search
CPC ..... B65D 81/3484
USPC .... 126/262, 263.01, 263.07, 263.08, 263.09; 422/38
See application file for complete search history.

(56) References Cited

U.S. PATENT DOCUMENTS 720,435 A 2/1903 Jewett
2,289,007 A 7/1942 Gessler
3,970,068 A * 7/1976 Sato ..... 126/263.08
4,528,218 A * 7/1985 Maione ..... A47J 36/28 126/263.08
4,640,264 A 2/1987 Yamaguchi et al.
4,741,324 A 5/1988 Ina et al.
4,751,119 A * 6/1988 Yukawa ..... A47J 36/28 126/263.08

(Continued)

FOREIGN PATENT DOCUMENTS

CN 2245409 Y 1/1997
CN 201010190 Y 1/1997

(Continued)

OTHER PUBLICATIONS

Hatanaka et al, JP H08-133348 English translation, May 28, 1996.*

(Continued)

*Primary Examiner* — Kenneth Rinehart
*Assistant Examiner* — Phillip Decker
(74) *Attorney, Agent, or Firm* — Steven R. Vosen

(57) ABSTRACT

An apparatus for providing a thermal treatment to a product, such as food, is described. One embodiment of the apparatus includes lime and water contained separately within a sealed reaction vessel. The reaction vessel includes a flexible wall portion that is adjacent to a perforator that can puncture a membrane separating the lime and water. In one embodiment, the perforator is separate from and fee-floating within the water. In another embodiment, the reaction vessel is substantially surrounded by the product. The reaction vessel is hermetically sealed against underpressure or overpressure, permitting use with pressurized food. The reaction vessel can be incorporated into a variety of containers and the reaction vessel and container can be sterilized for packaging food.

6 Claims, 4 Drawing Sheets

(56) References Cited

U.S. PATENT DOCUMENTS

| | | | | |
|---|---|---|---|---|
| 4,784,678 | A * | 11/1988 | Rudick | F25D 5/02 206/217 |
| 4,793,323 | A * | 12/1988 | Guida et al. | 126/263.08 |
| 4,819,612 | A | 4/1989 | Okamoto et al. | |
| 5,388,565 | A * | 2/1995 | Ou | 126/263.08 |
| 5,628,304 | A * | 5/1997 | Freiman | 126/263.09 |
| 5,809,786 | A * | 9/1998 | Scudder | A47J 36/28 126/263.01 |
| 5,979,164 | A * | 11/1999 | Scudder et al. | 62/4 |
| 6,029,651 | A | 2/2000 | Dorney | |
| 6,103,280 | A * | 8/2000 | Molzahn | A23G 9/00 426/109 |
| 6,141,970 | A * | 11/2000 | Molzahn et al. | 62/4 |
| 6,178,753 | B1 * | 1/2001 | Scudder | A47J 36/28 126/263.08 |
| 6,234,165 | B1 * | 5/2001 | Creighton | A47J 36/28 126/263.08 |
| 6,266,879 | B1 | 7/2001 | Scudder et al. | |
| 6,267,110 | B1 | 7/2001 | Tenenboum et al. | |
| 6,338,252 | B1 * | 1/2002 | Calderaio | 62/4 |
| 6,351,953 | B1 * | 3/2002 | Scudder et al. | 62/4 |
| 6,502,407 | B1 * | 1/2003 | Searle et al. | 62/4 |
| 6,601,577 | B2 * | 8/2003 | Bouskila | 126/263.08 |
| 6,877,504 | B2 | 4/2005 | Schreff et al. | |
| 6,880,550 | B2 * | 4/2005 | Miller et al. | 126/263.09 |
| 6,962,149 | B2 * | 11/2005 | Kolb | 126/263.08 |
| 7,004,161 | B2 * | 2/2006 | Kolb | 126/263.09 |
| 7,025,055 | B2 * | 4/2006 | Scudder | B65D 81/3484 126/263.08 |
| 7,117,684 | B2 * | 10/2006 | Scudder | F25D 5/02 126/263.09 |
| 2002/0144676 | A1 | 10/2002 | Bouskil | |
| 2005/0000508 | A1 * | 1/2005 | Schreft et al. | 126/263.09 |
| 2005/0145242 | A1 * | 7/2005 | Romeu | 126/263.09 |
| 2007/0125362 | A1 | 6/2007 | Ford et al. | |
| 2007/0131219 | A1 | 6/2007 | Ford et al. | |
| 2007/0163569 | A1 | 7/2007 | Strachan | |
| 2007/0204851 | A1 * | 9/2007 | Justo | B65D 81/3484 126/262 |

FOREIGN PATENT DOCUMENTS

| | | | | |
|---|---|---|---|---|
| CN | 2677328 | Y | 2/2005 | |
| CN | 1703603 | A | 11/2005 | |
| CN | 101142456 | A | 3/2008 | |
| EP | 2159165 | A1 * | 3/2010 | |
| JP | 8-133348 | A | 5/1996 | |
| JP | 8-217159 | A | 8/1996 | |
| WO | WO 9317928 | A1 * | 9/1993 | B65D 81/3484 |
| WO | WO 2006/101482 | A1 | 9/2006 | |
| WO | WO 2007/016416 | A2 | 2/2007 | |
| WO | WO 2010/022586 | A1 * | 3/2010 | |

OTHER PUBLICATIONS

Espelt, et al., WO 93/17928 A1 English machine translation, Sep. 16, 1993.*

Dec. 3, 2009, International Search Report—PCT/CN2009/000971.

CN—First Office Action, dated Sep. 28, 2012.

EP2159165A1 Search Report of Corresponding European Application, dated Mar. 3, 2010, Ngoc Thu, Huynh Thi.

* cited by examiner

APPARATUS FOR THERMAL CONDITIONING A PRODUCT

CROSS-REFERENCE TO RELATED APPLICATIONS

This application claims the benefit of U.S. Provisional Application No. 61/091,704, filed Aug. 25, 2008. The entire contents of the above-listed provisional application are hereby incorporated by reference herein and made part of this specification.

BACKGROUND OF THE INVENTION

Field of the Invention

The present invention generally relates to a self-contained food packaging system, and more particularly an apparatus for heating or cooling, or a container for packaging food including such an apparatus.

Discussion of the Background

There is a long-standing need for food package systems that can heat or cool the food. Prior art attempts at such systems typically include a chemically reacting mixture in a separate container that is stored within the package.

While various configurations of chemical systems and container shapes have been proposed, they all suffer from practical problems that have prevented their widespread acceptance. Examples of problems with various prior art configurations include: escape of hot chemicals from the reaction chamber, inefficient heating, devices to activate the chemical reactions that are difficult to use, difficulty in sterilizing the container for use with food, and difficulty in mating the portion having the chemical reacting mixture with a food container.

Thus there is a need in the art for an apparatus that permits for the easy operation of a heating or cooling device packages with a food container. Such an apparatus should be easy to sterilize and incorporate into a food package, should be able to be packaged with pressurized food, and should be safe to handle.

BRIEF SUMMARY OF THE INVENTION

The present invention overcomes the disadvantages of prior art by providing a self-contained reaction vessel that, depending on the chemical reactants contained therein, heat or cool a food product in contact with the vessel.

In one embodiment, a reaction vessel is provided, where the reaction vessel includes a sealed container having a reactant and a perforator, where the perforator can be moved by manipulating the reaction vessel to puncture the sealed container.

In another embodiment, a container and a reaction vessel is provided, where the reaction vessel is situated substantially within the food, where the reaction vessel includes a sealed container having a reactant, and a perforator that can pierce the sealed container.

In yet another embodiment, a container and a reaction vessel is provided, where the reaction vessel is sealed and is situated substantially within the food, where the reaction vessel generates heat by mixing reactants including water and lime.

In one embodiment, a reaction vessel for a container is provided that is hermetically sealed against overpressure and underpressure.

In another embodiment, a container having a reaction vessel for thermally treating food within the container is provided that permits food to be store using aseptic or hermetically treated methods. The container may be used to store, for example and without limitation, coffee, hot chocolate, soups with or without morsels.

In yet another embodiment, a reaction vessel for thermally treating food is provided that is a self-contained vessel that can be later provided to food packers for incorporation into a container and provided with food.

These features together with the various ancillary provisions and features which will become apparent to those skilled in the art from the following detailed description, are attained by the reaction vessel for thermally treating food, and container including the same, of the present invention, preferred embodiments thereof being shown with reference to the accompanying drawings, by way of example only, wherein:

BRIEF DESCRIPTION OF THE SEVERAL VIEWS OF THE DRAWING

FIG. 6A is prior to use, FIG. 6B is during activation; FIG. 6C is during heating of the product; and FIG. 6D is just prior to consumption of the product.

Reference symbols are used in the Figures to indicate certain components, aspects or features shown therein, with reference symbols common to more than one Figure indicating like components, aspects or features shown therein.

DETAILED DESCRIPTION OF THE INVENTION

Figure 1:
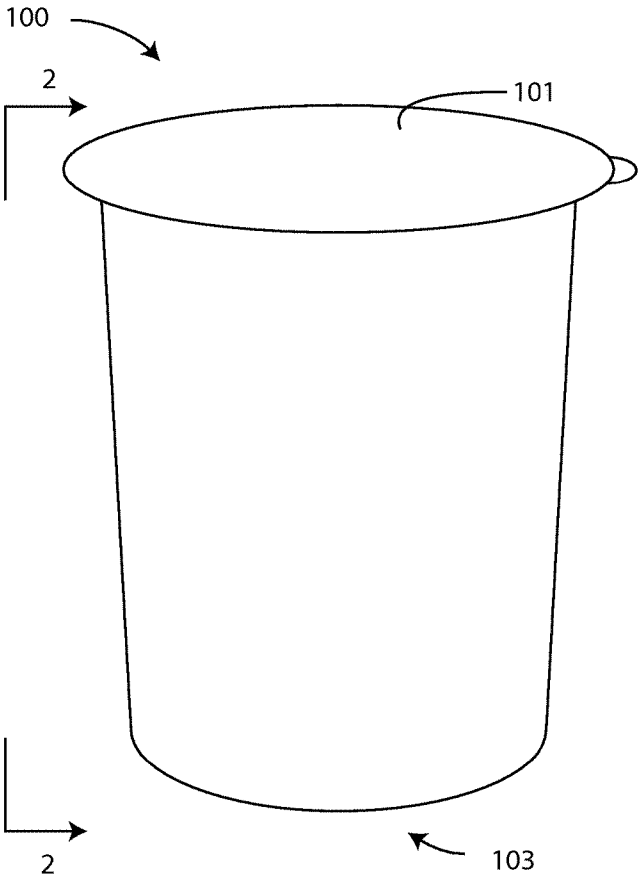
FIG. 1 is a perspective view of one embodiment of container for thermally conditioning a product.

FIG. 1 is a perspective view of one embodiment of a container 100 for thermally conditioning, that is heating or cooling, a product. The product may be, for example and without limitation, an edible product such as a food, a soup, or a drink, such as a baby formula or tea. The product may also be product that is not edible, such a wax to be used as a hot wax in a cosmetic treatment.

In the embodiment of FIG. 1, container 100 includes a removable lid 101 and an outer body 103. Outer body 103 is shown as being generally cylindrical, but may, in alternative embodiments, have the shape of a bowl, cup, or tub or other shape as is convenient for utilizing the thermally conditioned product, outer body 103 is transparent, translucent, or opaque, or includes printing or labels on all or part of its surface.

Figure 2A:
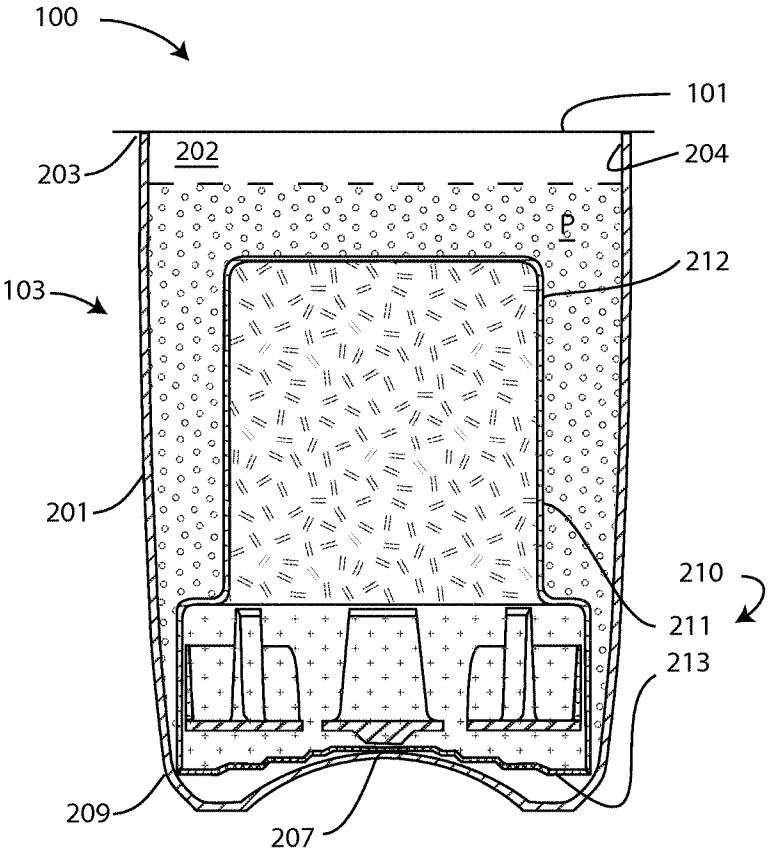
FIG. 2A is a sectional view 2-2 of FIG. 1.
Figure 2B:
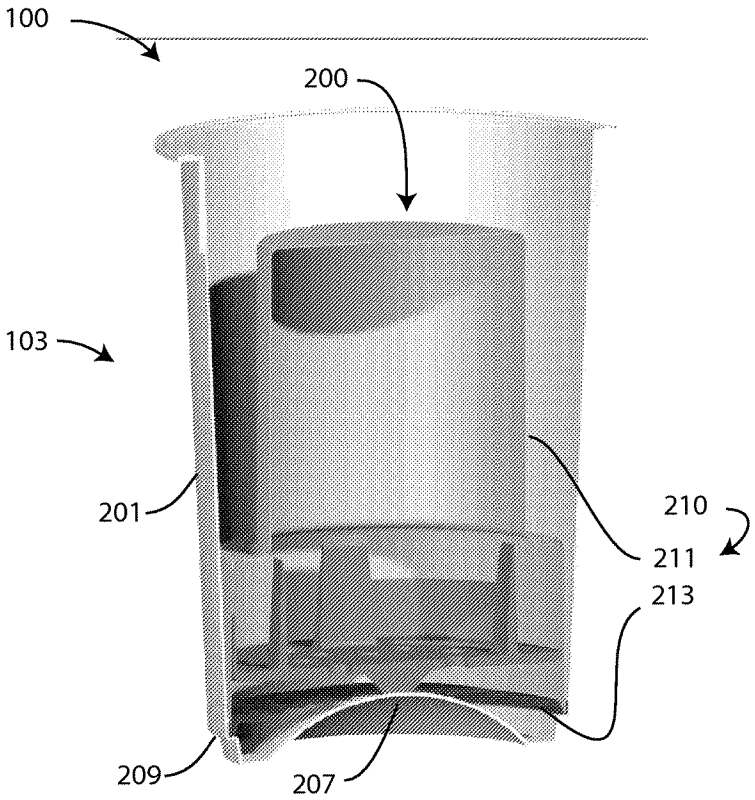
FIG. 2B is a perspective sectional view 2-2 of FIG. 1.

FIG. 2A is a sectional view and FIG. 2B is a perspective sectional view of one embodiment of a container 100, which may be generally similar to the embodiment illustrated in FIG. 1, except as further detailed below. Where possible, similar elements are identified with identical reference numerals in the depiction of the embodiments of FIGS. 1 and 2.

Container 100 includes a reaction vessel 210 comprising a reaction vessel body 211 and a reaction vessel bottom 213, and outer body 103 which includes a side 201 that extends from an opening 203 to a bottom 205. In the embodiment of FIGS. 2A and 2B, bottom 205 further includes a portion 207 that is adjacent to reaction vessel bottom 213.

Reaction vessel 210 is generally interior to outer body 103 and forms a hermetic seal with the outer bottom at a location 209 which is near side 201 and/or bottom 205. The seal at location 209 can be formed in a number of ways including, but not limited to, a press fit, an adhesive or other joining technique, or thermoforming outer body 103 to a protruding feature on reaction vessel 210.

Volume 202 includes the interior of outer body 103 including side 201 from opening 203 to sealing location 209, not including the volume occupied by reaction vessel 210. In one embodiment, some or all of volume 202 includes a product P. Locating reaction vessel 210 wholly or substantially within outer body 103 is advantageous, as this allows for efficient heating or cooling of the product contained therein with a minimal amount of heat transfer between the reaction vessel and the container exterior.

For container 100 that heats product P it is desirable that the product not occupy all volume 202 to accommodate any expansion of the product resulting from heating. It is preferred that internal surface 204 of side 201 and external surface 212 of reaction vessel body 211 is compatible with the edible product—that is, it will not contaminate or be corroded or dissolved by the edible product or any other material occupying volume 202. Further, it is preferred, but not required that outer surface 212 and/or the inner surface 204 can be sterilized for use with edible products packaged therein.

Outer body 103 may be formed from a variety of materials selected for their ability to maintain shape, resist moisture or gas permeation, and ability to be sanitized for filling with a food product. Materials selection is well known in the art and may include, but is not limited to, an injection molded polypropylene, a thermoformed polypropylene, or a thermoformed polypropylene/EVOH/polypropylene. The material and thickness may BE chosen for its ability to maintain shape and resist gas permeation. Methods of sanitizing, when required, include, but are not limited to, heating or treating with ozone or other chemicals.

Figure 3:
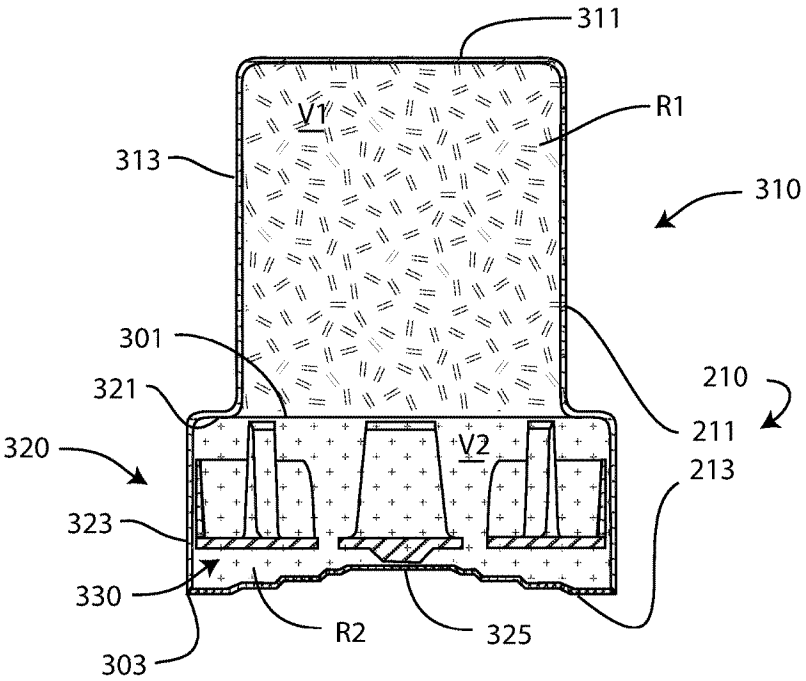
FIG. 3 is a sectional view 2-2 showing detail of one embodiment of a reaction vessel.

FIG. 3 is a detailed view of one embodiment of a reaction vessel 210, which may be generally similar to the embodiments illustrated in FIGS. 2A and 2B, except as further detailed below. Where possible, similar elements are identified with identical reference numerals in the depiction of the embodiments of FIGS. 1, 2A, 2B, and 3.

In general, reaction vessel 210 provides thermal conditioning of a product within volume 202. It is preferred, though not necessary, that reaction vessel 210 be structurally secure to contain the reacts and products within the vessel. Reaction vessel 210 contains the components to produce the necessary chemical reactions to create or absorb heat from product P. In one embodiment, reaction vessel body 211 is a metal can formed from aluminum, tin, or stainless steel, and reaction vessel bottom 213 is a metal piece that is formed with to be flexible when joined to the reaction vessel body. Optionally, varnished aluminum may be used to resist chemical activity with specific products. Reaction vessel body 211 and reaction vessel body 213 are thus, in one embodiment, metal pieces that are sealed along joint 303. Joint 303 may be a weld, crimped, or adhesive joint. The outer portion of reaction vessel 210 is preferably, thought not necessarily, formed from metal to ensures safe operation, by containing any reactants and reaction products within the reaction vessel, and efficient heat transfer with product P. Metal surfaces are also easily treated to be aseptic when required.

In one embodiment, reaction vessel 210 is formed of materials with sufficient strength to fully contain heated reactants and products, both during storage of the reactants and during and after reactions are completed. In another embodiment, reaction vessel 210 is sufficiently strong to maintain its shape when packaged in a pressurized container, such as when product P is pressurized. In yet another embodiment, reaction vessel body 211 and reaction vessel bottom 213 are formed from metal sheet having a thickness of approximately 0.2 mm to 0.8 mm. Thus for example, reaction vessel body 211 may be formed by stamping and reaction vessel bottom 213 is formed by stamping and rolling.

Reaction vessel bottom 213 has a central portion 325 which may move axially towards first compartment 310. Central portion 325 is adjacent to portion 207 of outer body 103 so that an inward movement of portion 207 will affect the volume of reaction vessel 210. This motion may be used to activate thermal conditioning, as described subsequently.

To provide thermal conditioning, reaction vessel 210 may, for example and without limitation, include two or more reactants separated during storage. As shown in FIG. 3, reaction vessel body 211 includes a top planar portion 311, a top cylindrical portion 313, a flange 321, and a bottom cylindrical portion 323. Reaction vessel 210 also includes a membrane 301 and a perforator 330. Membrane 301 is attached to flange 321, defining a first compartment 310, having a volume V1, that is bound by top planar portion 311, top cylindrical portion 313, and the membrane, and a second compartment 320, having a volume V2 that is bound by the membrane, bottom cylindrical portion 323 and reaction vessel bottom 213.

In one embodiment membrane 301 is aluminum coated or laminated with polyethylene or polypropylene, and is jointed to flange 321 with an adhesive or by heat or cold seal.

Figure 4:
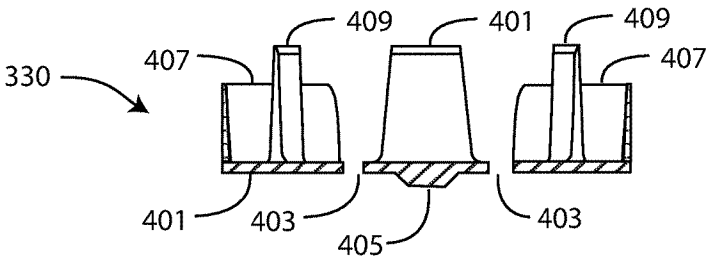
FIG. 4 is a sectional view 2-2 showing detail of one embodiment of a perforator.
Figure 5:
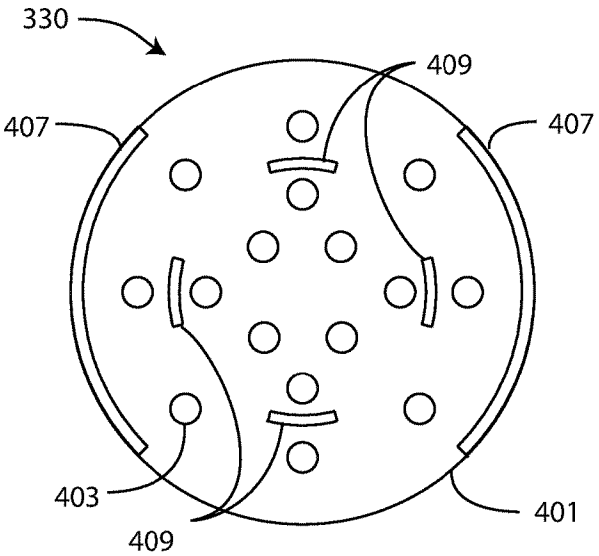
FIG. 5 is a top view of the perforator of FIG. 4.

FIG. 4 is a sectional view 2-2 showing detail of one embodiment of perforator 330, and FIG. 5 is a top view of the perforator, which may be generally similar to the embodiments illustrated in FIGS. 2A, 2B, and 3 except as further detailed below. Where possible, similar elements are identified with identical reference numerals in the depiction of the embodiments of FIGS. 1, 2A, 2B, 3, 4 and 5.

Perforator 330 is contained within second compartment 320. In one embodiment, perforator 330 formed from a plastic such as polypropylene and is loosely placed within second compartment 320. Perforator 330 is adapted to move axially along reaction vessel 210 and pierce membrane 310. Perforator 330 includes a base 401 having a plurality of holes 403, and has a central protrusion 405 on one side of the base and guide members 407 and piercing elements 409 on the other side of the base.

In one embodiment, guide members 407 include one or more portions that extend part or all the way around the circumference of perforator 330. The purpose of guide members 407 is to prevent perforator 330 from canting while moving towards membrane 301. In general, piecing elements 409 include one or more elements that extend toward membrane 301. The purpose of piercing elements 409 is to provide a force to puncture membrane 301. The plurality of holes 403 provide a way for the contents of second compartment 320 to move to accommodate the motion of perforator 330, and for the contents of first compartment 310 and second compartment 320 to mix and react once the membrane is punctured.

In general, perforator 330 is placed within second compartment 320 with central protrusion 405 adjacent portion 325, guiding members 407 adjacent bottom cylindrical portion 323, and piercing elements 409 adjacent membrane 310. To prevent accidental perforation of membrane 301 it is preferred that there be at least several millimeters of space between the piercing elements 409 and membrane 301 or between central protrusion 405 and portion 325.

In one embodiment, volume V1 of first compartment 310 is filled with a first reactant R1 and volume V2 of second compartment 320 is filled with a second reactant R2. As one example, which is not meant to limit the scope of the present invention, reactant R1 is quicklime (also know as burnt lime or lime) lime and reactant R2 is water. Quicklime consists primarily of calcium oxide (CaO) and it reacts with water to forming a hydrate and release heat via:

$$CaO+H_2O \longleftrightarrow Ca(OH)_2+(1150\ kj/kg\ of\ CaO)$$

In some embodiments, it is preferred that only a portion of one or more of volume V1 or V2 is filled. This is particularly true when the reaction in an enclosed volume generates substantial pressure by heating the reactants and/or products, or by increasing the volume of a liquid or solid within the reaction vessel 210. In one embodiment, 200 ml of a liquid food is heated from 20° C. to 60° C. with reaction vessel 210 having V1 of 170 ml provided with 100 g of CaO granulated, and V2 of 138 ml provided with 100 ml of water. This provides approximately 30% of free space in the unreacted reactant volume for expansion of the reactants and products in reaction vessel 210.

In other embodiments, reactants R1 and R2 may include a wide variety of compounds that are primarily select for their ability to produce or absorb heat without a large change in volume. Many such reactants are known in the field. The following combinations: calcium chloride and water are another set of reactants that are useful in generating heat. When one or more reactant R1 or R2 is a solid it is preferred, though not necessary for the solid to be granular to facilitate mixing and reactions.

Reaction vessel 210 may be prepared by placing reaction vessel body 310 with top planar portion 311 downwards, filling volume V1 with lime, sealing membrane 301 against flange 321, placing perforator 330 in second volume V1 with piercing elements 409 against the membrane, filling volume V2 with water, sealing reactor vessel bottom 213 onto the reaction vessel body. Reaction vessel 210 then may be joined to outer body 103, volume 202 may be filled with product P, and removable lid 101 may be sealed to opening 203.

In one embodiment, product P is pressurized when filling volume 202 (as would be the case for a carbonated beverage), and removable lid 101 is sufficiently strong to contain the pressure of the food.

In another embodiment, product P and container 100 are sterilized separately, and the product is then sealed in the container. In yet another embodiment, container 100 is filled with product P and sealed, and then sterilized. Thus, for example, the container 100 having product P sealed within is sterilized by heating the container.

Figures 6A, 6B, 6C, 6D:
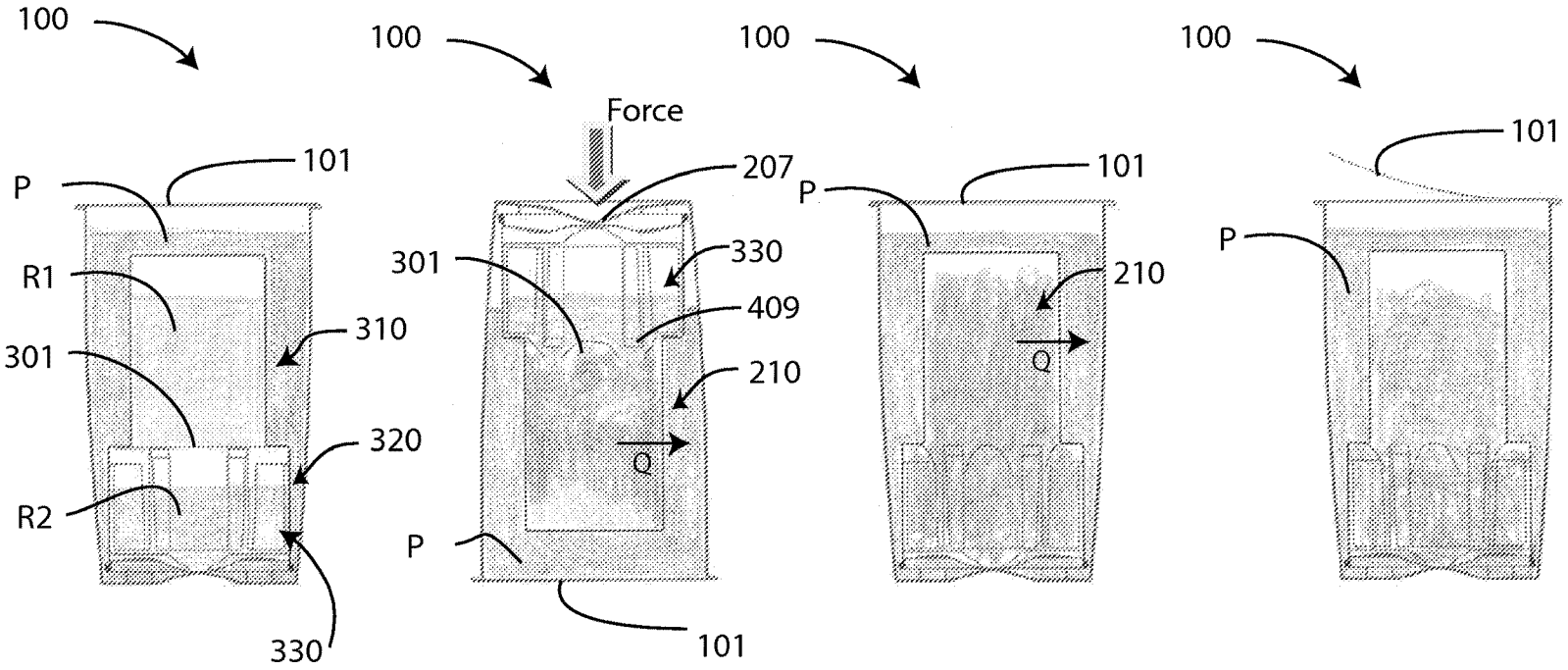
FIGS. 6A-6D are sequential sectional view of an embodiment of the self-heating container in use, where

FIGS. 6A-6D are sequential sectional view of an embodiment of container 100 in use, where FIG. 6A is prior to use, FIG. 6B is during activation; FIG. 6C is during heating of the product; and FIG. 6D is just prior to consumption of the product. Container 100 of FIGS. 6A-6D may be generally similar to the embodiments illustrated in FIGS. 1, 2A, 2B, 3, 4 and 5 except as further detailed below. Where possible, similar elements are identified with identical reference numerals in the depiction of the embodiments of FIGS. 1, 2A, 2B, 3, 4 and 5.

FIG. 6A shows container 100 in an upright and stored condition. FIG. 6B shows container 100 next turned upside down, with a force applied to portion 207. As described above, the force of portion 207 causes portion 325 to move inwards, resulting in perforator 330 to translate within second compartment 320 and cause piercing elements 409 to puncture membrane 301. With container 100 in this configuration, water within what was second compartment 320 drains into what was first compartment 310 and mix and react with the lime therein. Holes 403 permit perforator 330 to move through the water with reduced resistance and permit the water to easily mix with the lime. As the reaction proceeds, heat Q evolves from reaction vessel 210 and heats product P.

FIG. 6C shows container 100 righted for continued heating of product P, and FIG. 6D shows lid 101 removed so that the product may be consumed.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention.

I claim:

1. A reaction vessel to facilitate the mixing and reaction of a first component and a second component, where said reaction vessel is in thermal contact with a product, where the product substantially surrounds said reaction vessel, and where said reaction vessel comprises:

a first compartment to contain the first component;

a second compartment to contain the second component, where said second compartment includes a flexible wall portion and a cylindrical wall having an axis of rotation;

a membrane perpendicular to said axis and positioned between said first compartment and said second compartment, where said membrane, when intact, prevents fluid communication between said first compartment and said second compartment, and where said membrane, when pierced, allows fluid communication between said first compartment and said second compartment; and an actuator not affixed to said first compartment, said second compartment, or said membrane, where said actuator includes a base adjacent to said flexible wall portion, piercing elements that extend from said base in a direction towards said membrane, and a guide member that extends from said base in a direction towards said membrane forming an outer curved surface adjacent to said cylindrical wall and with the same curvature as said cylindrical wall, where when said flexible wall portion is flexed, said flexible wall portion contacts said base and forces each of said piercing elements to move in a direction perpendicular to said membrane.

2. The reaction vessel of claim 1, where said reaction vessel is configured to contain the first component, the second component, and any products of reaction of the first component and the second component.

3. The reaction vessel of claim 1, where said base include holes, such that fluid may flow through said base.

4. The reaction vessel of claim 1, where said outer curved surface has a length that is greater than one half of the length of said piercing members.

5. The reaction vessel of claim 1, where said membrane has a shape perpendicular to said axis that is a circle having a center and an outer edge, and where said piercing members pierce said membrane at one or more locations between the center and the outer edge.

6. The reaction vessel of claim 1, where said actuator is within said second compartment.

* * * * *